US005459902A

United States Patent [19]

Hino et al.

[11] Patent Number: 5,459,902

[45] Date of Patent: Oct. 24, 1995

[54] SLENDERIZED ANIMAL WOOL AND ITS MANUFACTURING METHOD

[75] Inventors: Ryohei Hino, Tsu; Tadashi Karakawa; Wasaburo Kengaku, both of Haguri; Takashi Kondo, Kyoto; Masaru Yamada, Haguri, all of Japan

[73] Assignee: Kurashiki Boseki Kabushiki Kaisha, Kurashiki, Japan

[21] Appl. No.: 81,088

[22] Filed: Jun. 24, 1993

[51] Int. Cl.[6] ..... D01H 5/00; D06M 13/00

[52] U.S. Cl. ..... 19/236; 8/128.1; 8/128.3; 8/149.3

[58] Field of Search ..... 8/128.1, 128.3, 8/149.1, 149.3, 150; 57/252, 362, 239, 245, 246; 19/236, 237, 258; 28/246

[56] References Cited

U.S. PATENT DOCUMENTS

| | | | |
|---|---|---|---|
| 1,008,249 | 7/1911 | Elsässer | 8/128.3 |
| 2,895,286 | 7/1959 | O'Connell | 8/128.1 |
| 3,447,310 | 6/1969 | Bok | 57/164 |
| 3,849,848 | 11/1974 | Umehara et al. | 28/72.17 |
| 3,871,165 | 3/1975 | Ishezawa et al. | 57/34 HS |

FOREIGN PATENT DOCUMENTS

| | | | |
|---|---|---|---|
| 2010145 | 2/1970 | France | 8/489 |
| 456606 | 2/1928 | Germany . | |
| 1927043 | 6/1970 | Germany . | |
| 1923377 | 11/1970 | Germany . | |
| 167837 | 8/1921 | United Kingdom . | |
| 9102835 | 3/1991 | WIPO . | |

*Primary Examiner*—Margaret Einsmann
*Attorney, Agent, or Firm*—Foley & Lardner

[57] ABSTRACT

A sliver of animal wool is subjected to hot drawing under its wet state to provide a slenderized fine animal wool.

14 Claims, 2 Drawing Sheets

SLENDERIZED ANIMAL WOOL AND ITS MANUFACTURING METHOD

BACKGROUND OF THE INVENTION

The present invention relates to an animal wool slenderized by drawing, its manufacturing method, and spun yarns obtained by blending the fiber with others.

A synthetic fiber is slenderized by drawing after it has been spun out. The primary object of this drawing is not only to make the fiber finer but to improve its strengths through orientation of its molecules. The fibers spun out are continuous, thus easy to draw.

Recently, with diversification of fashion, demands for clothing using fine animal wools are expanding. However, it has heretofore been inevitable to rely on natural raw materials for supply of fine fiber animal wools. Such fine fiber animal wools are very high priced, their output being extremely small. Finer the wools, higher the price. Techniques which enable their supply at low prices have been sought.

For slenderizing natural animal wools, for example, dissolving the surface of the animal wool or drawing the animal wool may be contemplated. The former approach is limited in thinning the fiber for the possibility of substantially impairing the hand, characteristics or strengths of the animal wool and therefore may be used only in special cases.

On the other hand, with regard to the latter approach, animal wools are different from synthetic fibers, the mean fiber length of Merino wool, for example, being normally 50–90 mm, such that their drawing on industrial scale has been quite out of consideration. In fact, since animal wools themselves have practically useful strengths, attempts to draw animal wools have never been made until now. Academic studies on complex changes that are induced when wool is drawn are available (e.g. Journal of the Textile Institute, Vol. 55, (1964–6) 324–332, WOOL SCIENCE REVIEW No. 15 (1956) 39–50, Education Department I.W.S.) but they have nothing to do with the techniques for providing slenderized animal wools on industrial scale. Nor are known any techniques for setting the slenderized animal wools in that state.

SUMMARY OF THE INVENTION

Animal wools hitherto generally used have been natural products. Their fineness are limited and supply of fine fiber of animal wools is limited. The present invention has as its object providing a method of obtaining slenderized animal wools by drawing simply from natural animal wools and a technique of obtaining fluffed animal wool spun yarns, using these fibers.

According to the present invention an animal wool having its natural wool drawn and slenderized to 95%–45% relative to its sectional area of the original wool (taken as 100%), and a method of manufacturing slenderized animal wools which comprises heat-drawing a sliver of an animal wool with its fiber axes paralleled in its wet state.

DETAILED DESCRIPTION OF THE INVENTION

Figure 1:
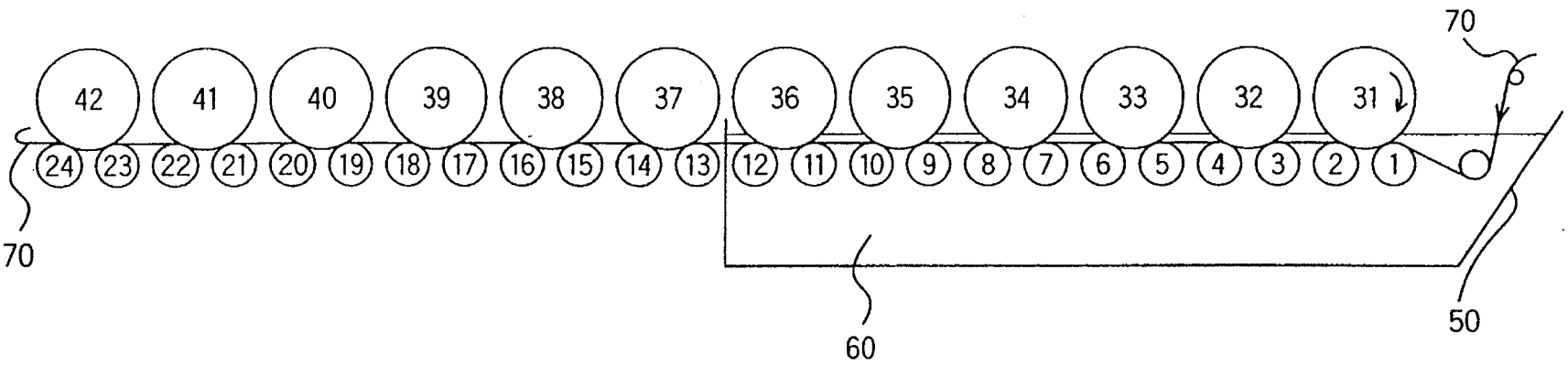
FIG. 1 is a schematic diagram of a drawing system used according to this invention.

The feature of the present invention is to provide an animal wool slenderized to 95%–45% relative to its sectional area of an original wool (taken as 100%); the second feature of the present invention is to provide a method of manufacturing a slenderized animal wool, which comprises heat-drawing a sliver of the animal wool with its fiber axes paralleled under wet or wet and swelled state; and the third feature of the present invention is to provide a method of manufacturing a fluffed animal wool, wherein the temporarily set slenderized animal wool and any non-slenderized animal wool are blended and spun and thereafter the slenderized animal wool is restored to its original length.

In manufacturing the slenderized animal wool of the present invention, first a sliver of an animal wool with its fiber axes paralleled is produced. As this sliver, any animal wool slivers which have hitherto been generally supplied are usable. The fibers of the sliver should desirably be so arranged as to be thinly spread by applying a draft for lengthening them about thrice using a rotary gill, but the process is not limited to this. A usable animal wool is typically sheep wool, but Vicuna wool, Mohair, Angora goat wool, Cashmere wool and the like may be taken up as examples. Of course the usable materials are not limited to them. The finenesses or the mean diameters of the original animal wools are normally from 13 μm to 38 μm. Animal wools of whatever fiber diameters are slenderizable.

The length of the animal wool should preferably be at least 30 mm or longer, particularly 40 mm or longer. If the fiber length is shorter than 30 mm, the distance between nip-rollers needs to be 30 mm or shorter, causing difficulty in drawing because of the limitation from the roller diameter and other factors. The animal wool sliver is hot-drawn in its wet state. The wet state may be obtained by dipping the animal wool in water, for example. The water may be mixed with any suitable mixing agent, an additive, a hydrogen bond breaking agent, a cross-linkage breaking agent, a hydrophobic bond relaxer and so on. Illustrated as mixing agents are water soluble organic solvents, e.g. lower alcohols such as methyl alcohol and ethyl alcohol, alkanal amines such as ethanol amine; and as additives are surface active agents, e.g. alkoxylated higher alcohol or alkylphenyl ether type nonionic surface active agents etc. The animal wool wetted with water or water containing any of the aforementioned mixing agents or additives will restore its original length, when steeped in warm or hot water, after subjected to its slenderization treatment. That is to say, its slenderized form remains unset. This is useful in manufacturing fluffed animal wool spun yarns which will be described later.

The hydrogen bond breaking agent, cross-linkage breaking agent, hydrophobic bond relaxer and so on break the hydrogen bond or the cross-linkage of the animal wool, thereby achieving more effective drawing of animal wool. If any of these additives is used in a suitable amount to allow the broken cross-linkage to be cross-linked again, the slenderized form is set and will not restore its original fineness, even if the fiber is treated with warm or hot water.

Mentioned as cross-linkage breaking agent are disulfide bond breaking agents such as thioglycolic acid and thioglycols; ammonium salts; thiol compounds such as alkyl mercaptans, mercaptoalcohols and mercaptoamines; and reducing agents such as sulfur containing amino acids, sodium sulfite, monoethanol amine sulfite, monoethanol amine bisulfite, etc.

Illustrated as hydrogen bond breaking agents and hydrophobic relaxers are urea, phenol, acetamide, formamide, sodium thiocyanate, sodium salicylate, lithium bromide, etc. Lower alcohols such as n-butanol, n-propanol and isopropanol have these actions.

These additives are not limited to the above-mentioned. They may be used in mixture. It can not be said in general, but suitable amount of surface active agents etc. to be added is 10 g/l or less, depending on the type of the mixing agent or the additives used and the object of their use, for the purpose of enhancing the effect of their penetration into the interior of the fiber. The amount of addition of symmetric reducing agents such as thioglycolic acid or mercaptoethanol as the cross-linkage breaking agents should be 0.05%–10% by weight and that of, for example, urea as the hydrogen bond breaking agents or as the hydrophobic bond relaxer should preferably be not more than 5 mol %, particularly 3 mol %.

The wetting temperature is not limitative, but may be selected arbitrarily in a range from a room temperature to boiling temperature. Wetting may be achieved with steam. The pH value of the liquid for use in the wetting may appropriately be selected in a range from weak alkaline to acidic values. Particularly preferably, it should be from pH 2.5 to pH 8.5. The wetting time that assures adequately uniform permeation of the wetting liquid into the interior of the animal wool should normally range from 1 to 60 min. Such wool may be pretreated with cross-linkage breaking agent etc. to make it easy swellable.

The hot drawing may be performed either after wetting the animal wool or simultaneously with its wetting. The heating temperature should be form 40° C. to 100° C., more preferably from 60° C. to 95° C. The heating may be done, while wetting it with steam. Simultaneous wetting and heating may be carried out with the wetting liquid itself having been heated beforehand. The heating may be performed in the drawing atmosphere which is held at the heating temperature or with the heating apparatus itself, for example the drawing rollers, heated.

Figure 2:
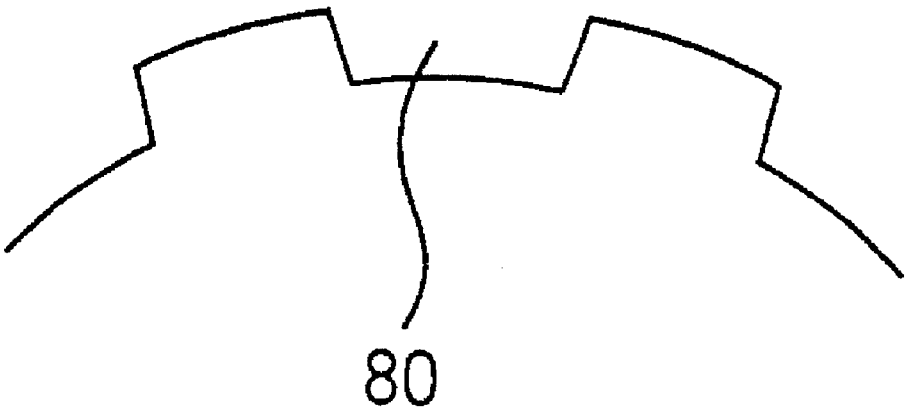
FIG. 2 is a partly enlarged sectional view of a bottom roller showing its surface.

The drawing may be typically performed with drawing rollers. The drawing rollers may be, as shown in FIG. 1, composed of top rollers 31–42 and bottom rollers 1–24, the top rollers having at least their surfaces made of rubber. Preferable construction of the drawing roller system will be explained below with reference to FIGS. 1 and 2. FIG. 1 shows a drawing system, the first half representing the wetting process, and the second half the heating process. With a wetting liquid 60 put in a steeping tank 50, an animal wool sliver 70 is drawn, while being wetted in the steeping tank, by means of nip rollers consisting of bottom rollers 1–13 and top rollers 31–36. The animal wool sliver coming out of the steeping tank 50 is moved to a heating process in an ambient atmosphere of heating steam or hot air, to be set under the drawing conditions. The sliver is pressed by the top rollers 31–42 and the bottom rollers 1–24. The numbers of the top and bottom rollers are of course not limited to those shown in FIG. 1. The number of places where it is pressed and drawn should be two or more, preferably four or more. If it is less than four, the drawing and the setting is often insufficient. In order to obtain fluffed spun yarns as described later, it may be proper to intentionally reduce the number of places so that a partly slenderized or incompletely set animal wool is obtained. On the surface of the bottom rollers, a lateral flute 80 is carved, as shown in FIG. 2. Into this flute the animal wool is caught and the rotating speeds of respective rollers are set higher stepwise toward the rear, thereby effecting the drawing. Thus the drawing is effected by increasing the rotating speed of each of the rollers situated at the odd numbered places, the second one of each of the paired bottom rollers (2, 3), (4, 5), (6, 7) . . . (22, 23), i.e. parts where the animal wool is not in contact with the top rollers. Accordingly, the distance between each paired rollers mentioned above must be shorter than the length of the animal wool to be drawn. The feeding rate should be adjusted by altering the rotational speed and the radius of each roller. The drawing multiplicity is nearly proportional to the ratio of the rotational speed of the first roller 2 to that of the last roller 23, if the diameters of all the bottom rollers are equal. Thus in order to make the drawing multiplicity of 1.4 or 2.2 times, the ratio of the rotational speed of the roller 23 to that of the roller 2 is changed to about 1.4 or about 2.2.

The bottom rollers 1–24 mentioned above should preferably be fluted rollers as shown in FIG. 2 (a schematic partially enlarged view). Appropriate widths of the projected portion and recessed portion of the fluted rollers should be about 1.45 mm and about 2.00 mm, respectively. Appropriate depth of the flute of the fluted rollers should be around 1 mm. These dimensions however are not limited thereto. Besides, the flute may be either parallel or spiral. The material of the bottom rollers is not particularly specified, and may be stainless steel or molding plastics, for example. In keeping with the working conditions, their chemicals resistance and heat resistance should be taken into account. The diameters and the distances between axis of bottom rollers should be respectively selected in reference to the diameters of the top rollers and the length of the animal wool. The diameters of the bottom rollers should preferably be from about ½ to ⅓ of those of the top rollers, normally being from 20 mm to 28 mm and their between-axis distances should preferably be from about 22 to 32 mm.

For prevention of fiber slippage, it is preferable to apply a pressure from 20 kg to 300 kg between the top and bottom rollers.

The top rollers 31–42 should preferably have a rubber layer on the surface of each of them. The hardness of the rubber should be from 50° to 120°, more preferably from 65° to 85°. Appropriate diameter of the top rollers should be from 40 mm to 60 mm. The distance between adjacent top rollers should be so set that the distance between adjacent contacts between the top and bottom rollers be shorter than the length of the animal wool. Preferably, it should generally be from about 95% to 50% of the fiber length.

By the drawing treatment as hereinabove described, the animal wool can be drawn up to about 2.2 times (slenderized to 45% of the sectional area of the raw wool). Drawing after wetting with water only, without using any wetting agent, enables the drawing about 1.5 times.

An animal fiber subjected to a wet swelling treatment under relatively mild conditions and set by heating only is merely temporarily set. Such fiber will restore its former length, when treated with hot water. By taking advantage of this fiber's property, it is possible to obtain a bulky or fluffy animal wool spun yarn.

While the slenderization may be effected with the form set to some extent by conducting the wetting treatment, making use of any cross-linkage breaking agent, a hydrogen bond breaking agent or hydrophobic bond relaxer, etc., if the fiber is further treated after its setting with such oxidizing agents as hydrogen peroxide, potassium bromate or any —SH blocking agents, the setting of the deformed state is more perfect; this deformed state is maintained nearly intact even after its treatment in hot water for 60 min. Such a treatment as by using hydrogen peroxide may be performed, either with tension applied or not.

The temporarily set slenderized animal wool may be blended with any non-slenderized animal wools or other fibers, e.g. polyester, polyamide, acrylic, cotton or the like. Then the spun yarn thus obtained is treated in warm or hot water, whereby the slenderized animal wool restores its original length in the spun yarn, causing the yarn to fluff as a whole, yielding a bulky yarn. From such a spun yarn, cushion materials, textiles or knit goods with favorable hands can be obtained.

The present invention is described in connection with its preferred embodiments:

EXAMPLE 1

A long sliver with an about 18 g/m density was prepared from a pure sheep wool sliver with a 21.11 μm mean fiber diameter and 80 mm avg. and 155 mm max. fiber lengths, using a rotary gill. This prepared sliver was drawn under a 160 kg nip pressure at a 5 cm/min. feed rate, using a drawing system of FIG. 1. The wetting was performed with use of 80° C. water.

The specifications of the drawing system were as follows:

Bottom rollers: 24 steps; made of stainless steel; diameter 20 mm, working width 200 mm; width of recessed part 2 mm, width of projected part 1.45 mm and depth 1 mm.

Of the 24 step bottom rollers, rollers up to the 12th step were steeped in a wetting solution. The distance between axis between the rollers of each of the bottom roller pairs (1, 2); (3, 4); (5, 6); (7, 8); (9, 10) and (11, 12) was all set at 28 mm and each pair was rotated at the same speed. The drawing was effected between adjacent two bottom rollers (2, 3); (4, 5); (6, 7) and (8, 9) and the distance between axis between them was all set at 24 mm. The rotational speed of the bottom roller 1 was 0.8 rpm. The speed ratio of the latter step to the preceding one in each pair of rollers was set equally at 1.05 times from (2, 3) . . . through (12,13), thus increasing the speed in 6 stages at this ratio. The process on the bottom rollers from 14 to 24 is for setting, while similarly drawing the fiber, with heating done under a 2 kg/cm$^2$ steam pressure. The speed ratios of the latter to the preceding step of adjacent bottom rollers (14, 15); (16, 17); (18, 19); (20, 21) and (22, 23) were respectively 1.15, 1.10, 1.10, 1.05 and 1.02 times; thus 1.49 times drawing was effected.

The top rollers were made of rubber with an 80° hardness, had a 50 mm diameter and the distance between adjacent rolls, as measured between their axes, was 52 mm.

The drawn sliver obtained in this way was air-dried at a room temperature. The average of the diameters of monofilaments of the sliver obtained was 18.65 μm and it had 87 mm avg. and 212 mm max. fiber lengths.

A highly glossy spun yarn (metric count 1/52, Z490) was obtained by the normal spinning process, using this sliver. It was then steamed at 80° C. for 15 min. and plied, and thereafter treated in hot water at 100° C. for 30 min, to give a fluffed spun yarn for knit goods (2/48, Z520, S300). The bulkiness according to JIS L-1095 was 8.4 cm$^3$/g (load 10 g/cm$^2$).

COMPARATIVE EXAMPLE 1

A spun yarn for knit goods (2/48, Z520, S300) was obtained, using the untreated sliver of the same lot as in Example 1. Its low bulkiness as compared with the yarn obtained in Example 1 was evident by touch. Its bulkiness was measured to be 7.6 cm$^3$/g.

EXAMPLE 2

A sheep wool sliver with a 31.03 μm mean fiber diameter was drawn in the same way as in Example 1, except that, as a wetting liquid, an aqueous solution (adjusted to pH 2.5 with a 25% by weight of ammonia water) containing 1.0% by weight of thioglycolic acid and 1.5 mol of urea, was used at 80° C.

The rotational speed ratio for each of 6 steps from the bottom rollers 2 through 13 was increased 1.02 times at all steps. The speed ratios from the bottom rollers 14 through 23 were set the same as those in Example 1. The mean fiber diameter of the sliver drawn under the above-mentioned conditions and then air-dried was found to be 25.65 μm. This sliver blended with an untreated sliver at 3:7 was spun to have 1/7.5 (Z150). Then after steaming this yarn at 60° C. for 10 min, a hand-knitting wool yarn of a 3/7.5 (S85) metric count was obtained. When reeled and hank-dyed by the usual method, this yarn turned into very bulky unyielding hand-knitting woolen yarn of 3/6 (Z155, S90). Its bulkiness was measured to be 12.0 cm$^3$/g.

COMPARATIVE EXAMPLE 2

A hand-knitting wool yarn (metric count 3/6, Z155, S90) was obtained by spinning the untreated sliver (mean fiber dia. 31.03 μm) of Example 2 only. This yarn was dyed by the same method as in Example 2. No changes in count and twist were recognized after the dyeing and its hand was distinctly different from that of Example 2. Its bulkiness was measured to be 10.6 cm$^3$/g.

EXAMPLE 3

The treatment was performed by the procedure of Example 1 using a sheep wool sliver with a 20.59 μm mean fiber diameter and 77 mm avg. and 150 mm max. fiber lengths. As the wetting liquid, an aqueous solution containing 2.0% by weight of thioglycolic acid and 1.5 mol of urea with its pH adjusted to 3.7 with a 28% ammonia water was used. The speed ratios between adjacent two rollers were set as listed hereinbelow:

| Roller No. | Speed ratio |
|---|---|
| 2–3 | 1.02 |
| 4–5 | 1.02 |
| 6–7 | 1.08 |
| 8–9 | 1.08 |
| 10–11 | 1.02 |
| 12–13 | 1.02 |
| 14–15 | 1.16 |
| 16–17 | 1.14 |
| 18–19 | 1.10 |
| 20–21 | 1.05 |
| 22–23 | 1.02 |

The fiber, after drawn under the above mentioned conditions, was water-rinsed for 10 min in a top dyeing machine and then treated with a 1% by weight aqueous solution of hydrogen peroxide (pH 7, 40° C.) for 10 min. Thereafter, the treated fiber was rinsed by a backwasher, followed by drying.

The diameter and the lengths of the monofilament of the sliver compare with those of the untreated as given in the table below:

| | Drawn | Untreated |
|---|---|---|
| Mean fiber dia. | 17.44μ | 20.59μ |
| Fiber lengths: | | |
| avg. (for the number of filaments) | 119 mm | 77 mm |
| (Fiber dia.) | (17.01μ) | (19.91μ) |
| max. | 275 mm | 150 mm |
| (Fiber dia.) | (16.19μ) | (21.22μ) |
| min. | 50 mm | 50 mm |
| (Fiber dia.) | (18.25μ) | (20.25μ) |

As listed above, a fine and long wool fiber was obtained.

By spinning this sliver by the usual process, a very glossy yarn of a 1/100 (Z900) metric count was obtained. Its hot water shrinkage was 1.62%, as measured by the method of JIS L-1095 7.24A after steaming at 80° C. for 15 min. The value of this hot water shrinkage was nearly equal to that of the ordinary spun yarn.

EXAMPLE 4

A sheep wool slenderized in the same way as in Example 3 except for the use of the undermentioned aqueous solution as the wetting liquid. As a wetting liquid, an aqueous solution containing 0.5% by weight of thioglycolic acid and 1.6 mol of urea, with its pH adjusted to 7.5 with ammonia water, was prepared. Since this aqueous solution was slightly tinted in pink, it was used with addition of 10 g/l of a 0.2 mol aqueous solution of EDTA-4Na. The nip pressure between rollers was adjusted to 120 kg.

The sheep wool treated under the above-mentioned conditions was nearly identical with that of Example 3. From this fiber, a spun yarn of 1/100 (Z900) was similarly obtained.

We claim:

1. A method of manufacturing a slenderized animal wool fiber, comprising the steps of (A) drawing a wetted sliver of the animal wool by means of a plurality of drawing rollers at a multiplicity of from 1.4 to 2.2 times, and then (B) setting the drawn sliver with heat while the sliver continues to be drawn by the plurality of drawing rollers.

2. The method of claim 1, wherein the drawing rollers comprise top rollers and bottom rollers.

3. The method of claim 1, wherein the heat is provided in the form of steam.

4. The method of claim 2, wherein the bottom rollers have a diameter of from 20 mm to 28 mm, and the between-axis distance of the rollers is in the range of from 22 to 32 mm.

5. The method of claim 2, wherein the surfaces of the bottom rollers are provided with flutes, and the surfaces of the top rollers are provided with a rubber-like layer.

6. The method of claim 2, in which the diameters of the top rollers are in the range of from 40 mm to 60 mm.

7. The method of claim 2, wherein the distance between adjacent contacts between the top and bottom rollers is shorter than the length of the animal wool fibers.

8. The method of claim 2, wherein pressure in the range of from 20 kg to 300 kg is applied between the top and bottom rollers.

9. The method of claim 1, wherein the drawing of the sliver in step (A) is carried out at a temperature in the range of from 40° C. to 100° C.

10. The method of claim 1, wherein the sliver is wetted by exposing the sliver to steam, or by dipping the sliver in one or more liquids selected from the group consisting of water, an aqueous solution of a hydrogen bond breaking agent, a crosslinkage breaking agent and a hydrophobic bond relaxer.

11. The method of claim 1, in which the wetting is achieved in a liquid having a pH value in the range of from 2.5 to 8.5.

12. The method of claim 2, wherein the number of the bottom rollers is four or more.

13. The method of claim 1, further comprising before step (A), the step of (C) processing the sliver in a rotary gill to spread and lengthen the sliver.

14. The method of claim 1, further comprising after step (B), the step of (D) treating the wool sliver with oxidizing agents.

* * * * *